US007299521B2

(12) United States Patent
Theiss, Jr. et al.

(10) Patent No.: US 7,299,521 B2
(45) Date of Patent: Nov. 27, 2007

(54) BRUSH ASSEMBLY DISTRIBUTION APPARATUS

(75) Inventors: William H. Theiss, Jr., Canton, OH (US); Robert W. Bauman, North Canton, OH (US); Dale L. Buxton, Canton, OH (US); David B. Rennecker, Canton, OH (US)

(73) Assignee: The Hoover Company, North Canton, OH (US)

( * ) Notice: Subject to any disclaimer, the term of this patent is extended or adjusted under 35 U.S.C. 154(b) by 294 days.

(21) Appl. No.: 10/287,179

(22) Filed: Nov. 4, 2002

(65) Prior Publication Data

US 2004/0084062 A1 May 6, 2004

(51) Int. Cl.
*A47L 11/282* (2006.01)

(52) U.S. Cl. ..... 15/322; 15/50.1

(58) Field of Classification Search ..... 15/50.1, 15/385, 320, 28, 49.1, 87, 98, 383, 179, 398, 15/322; 134/21, 137, 157, 163
See application file for complete search history.

(56) References Cited

U.S. PATENT DOCUMENTS

| | | | | |
|---|---|---|---|---|
| 3,381,326 | A | 5/1968 | Dolan et al. | |
| 3,644,960 | A * | 2/1972 | Danzig | 15/322 |
| 4,012,805 | A * | 3/1977 | Schneider | 15/50.1 |
| 5,867,857 | A | 2/1999 | Crouser et al. | 15/50.1 |
| 6,009,593 | A | 1/2000 | Crouser et al. | 15/320 |
| 6,052,854 | A | 4/2000 | Besel et al. | |
| 6,189,174 | B1 | 2/2001 | Crouser et al. | 15/28 |
| 6,367,109 | B1 | 4/2002 | Besel et al. | |

* cited by examiner

*Primary Examiner*—Theresa T. Snider
(74) *Attorney, Agent, or Firm*—A. Burgess Lowe; Brett A. Schenck

(57) ABSTRACT

A floor-scrubbing machine is provided having a main body and a cleaning fluid delivery system. At least one rotatable brush having a brush body and bristles extending from the brush body is included. The brush is carried by the main body whereby the bristles of the brush engage the floor being scrubbed. A fluid distributor is provided to distribute cleaning fluid supplied to the fluid distributor to the brush. The brush defines a recess having a sidewall and at least one opening formed in the sidewall for distributing the cleaning solution radially outward.

16 Claims, 6 Drawing Sheets

BRUSH ASSEMBLY DISTRIBUTION APPARATUS

BACKGROUND OF THE INVENTION

1. Field of the Invention

The present invention relates to a cleaner such as a carpet-cleaning device having a power brush assembly. More particularly, the present application pertains to such a brush assembly that distributes the cleaning solution onto the surface.

2. Background Information

It is known in the prior art to provide a carpet extractor having powered brushes to assist in scrubbing of the surface being cleaned as disclosed in U.S. Pat. No. 6,009,594 issued to Crouser. Such a brush assembly 20 includes gear brushes 25 that each distribute the cleaning solution axially through openings 81 in the bottom of brush cups 77 formed in its center hub. However, visual analysis of the fluid distribution on the carpet revealed that the solution was more concentrated under the brush hub, which could result in some areas in the cleaning path to be less cleaned than the other areas.

Hence, it is an object of the present invention to provide a brush assembly for a cleaning machine that distributes cleaning solution evenly along the cleaning surface in its cleaning path.

It is another object of the present invention to provide a brush assembly of a cleaning machine that distributes cleaning solution along the cleaning surface in manner that improves the cleaning of the surface.

SUMMARY OF THE INVENTION

The foregoing and other objects of the present invention will be readily apparent from the following description and the attached drawings. In one aspect of the present invention, a floor-scrubbing machine is provided having a main body and a cleaning fluid delivery system. At least one rotatable brush having a brush body and bristles extending from the brush body is included. The brush is carried by the main body whereby the bristles of the brush engage the floor being scrubbed. A fluid distributor is provided to distribute cleaning fluid supplied to the fluid distributor to the brush. The brush defines a recess having a sidewall and at least one opening formed in the sidewall for distributing the cleaning solution radially outward.

In another aspect of the present invention a floor-scrubbing machine is provided having a main body and a cleaning fluid delivery system. At least one rotatable brush having a brush body and bristles extending from the brush body is included. The brush is carried by the main body whereby the bristles of the brush engage the floor being scrubbed. A fluid distributor is provided to distribute cleaning fluid supplied to the fluid distributor to the brush. The brush defines a recess having a sidewall and at least one opening formed in the sidewall for distributing the cleaning solution. At least one opening formed in the recess for distributing the cleaning solution. A rim extends downwardly from the bottom wall of the brush recess. The rim is positioned radially inward from the opening.

In another aspect of the present invention, a method of distributing cleaning solution on a cleaning surface using a cleaning machine having a brush assembly is provided. The brush assembly has at least one brush defining a recess having openings. The method comprises the steps of flowing the cleaning solution into the recess and rotating the brush such that the cleaning fluid flows radially from the opening.

BRIEF DESCRIPTION OF THE DRAWINGS

The invention will now be described, by way of example, with reference to the attached drawings, of which.

DETAILED DESCRIPTION OF THE PREFERRED EMBODIMENT

Figure 1:
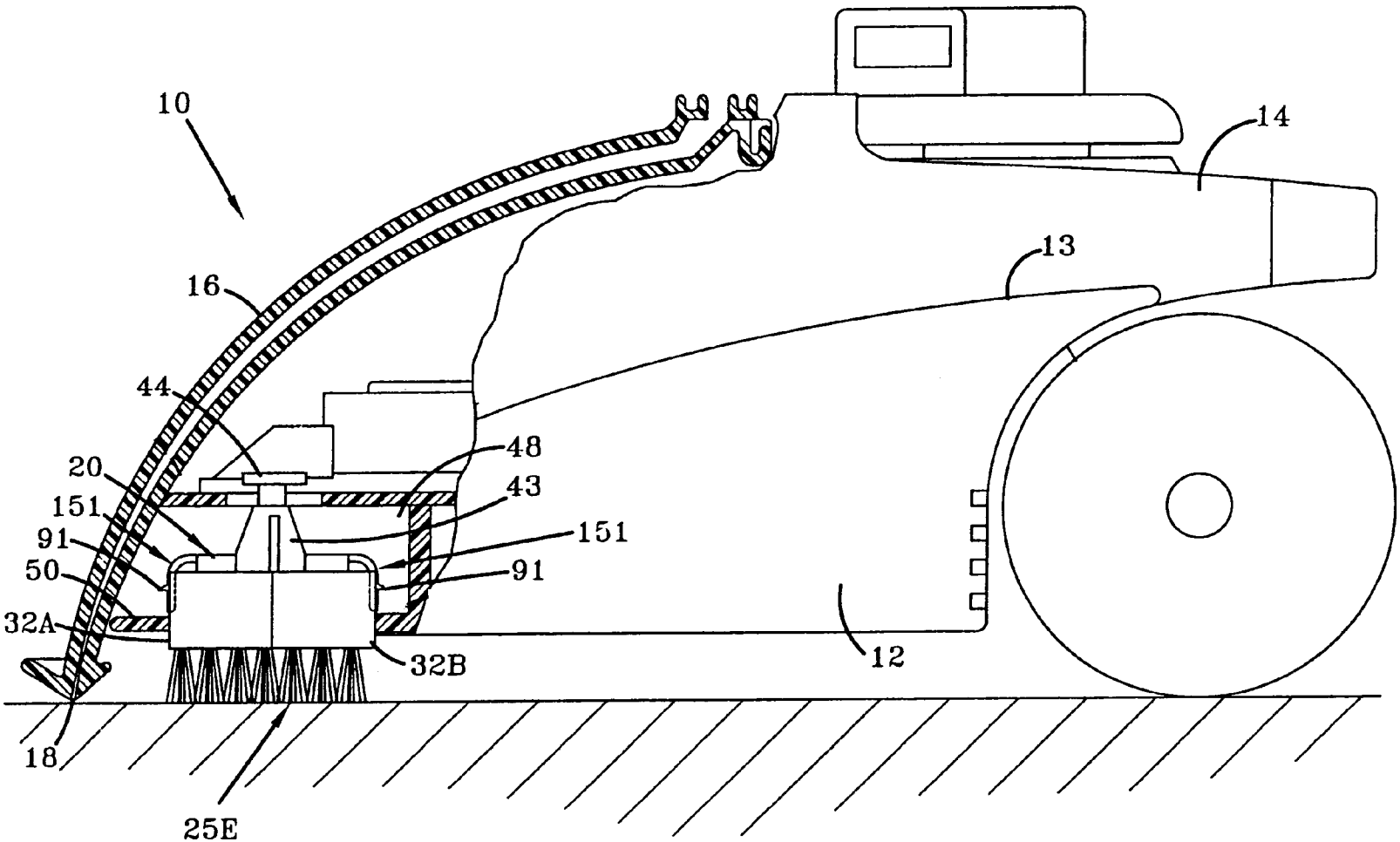
FIG. 1 is a left side elevational view of the base module of an upright cleaner having the forward portion thereof cut away to illustrate the general positioning of the brush assembly therein according to the present invention.

In one embodiment of the present invention, a base module 10 for an upright carpet extractor is shown in FIG. 1. The upper portion of a typical upright carpet extractor suitable for use in combination with the herein described base module 10 may be found in co-owned U.S. Pat. No. 5,406,673 issued on Apr. 18, 1995, titled "Tank Carry Handle and Securement Latch", the contents of which are included herein by reference. The base module 10 is similar to the one found in previously mentioned co-owned U.S. Pat. No. 6,009,593; the disclosure of which is incorporated by reference. In general, the base module 10 comprises a lower housing 12 and an upper housing 14, which generally separate along parting line 13. A suction nozzle 16 and a suction inlet 18 are part of the upper housing 14 similar to that taught in the above referenced co-owned patents. A floating carpet scrubbing brush assembly 20 is suspended in the lower housing 12. The brush assembly 20 may be powered by an air driven turbine, or any suitable motive power means typically used in the industry, through a suitable gear drive train or transmission.

Figure 2:
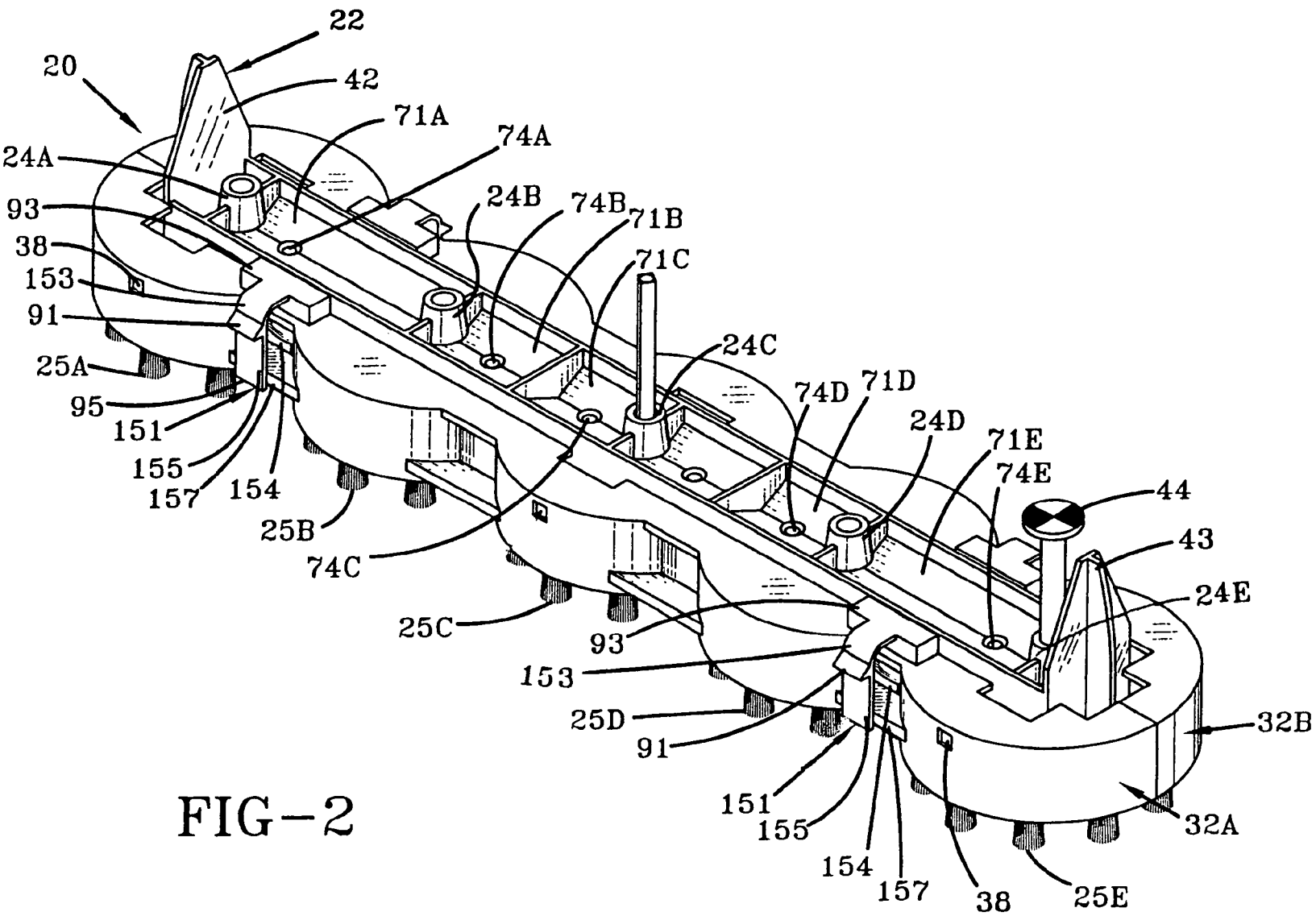
FIG. 2 is a top perspective view of the brush assembly according to the present invention.

As shown in FIG. 2, the brush assembly 20 comprises a brush support beam 22 having five spaced apart integrally molded, cylindrical bearings 24A, 24B, 24C, 24D, and 24E. Rotatingly received within bearings are axial shafts 26 (FIGS. 3 through 10) of gear brushes 25A, 25B, 25C, 25D, and 25E. The beam 22 further includes troughs 71A, 71B, 71C, 71D, and 71E, for receiving a cleaning solution. The cleaning solution flows through supply conduits 74A, 74B, 74C, 74D, and 74E, of the beam and then outward toward the surface being cleaned through openings 81, 168, 268 in the brush cups or recesses 77, 177, 277, 377 as seen in the embodiments of FIGS. 3 through 10 which will be explained in further detail. Gear guards 32A and 32B are attached to the brush support beam 22 and are identical in construction so as to be interchangeable on either side of brush support beam 22. A gear brush rotator indicator 44 is fixedly attached to the shaft extension 29 (FIG. 5 of U.S. Pat. No. 6,009,593) of gear brush 25E.

Integral to and extending upward from the opposite lateral ends of brush support beam are "T" shaped rails 42 and 43. T-rails 42 and 43 are slidably received within vertical guide slots 46 and 47 (FIG. 3 of U.S. Pat. No. 6,009,593) integrally molded into the lower base module housing 12 whereby brush assembly 20 may freely move or float in the vertical direction within the brush assembly cavity 48 of housing 12. A plurality of downwardly projecting tangs 151 extends from the top cover plates of the gear guards 32A and 32B, respectively as best seen in FIG. 2. Each of the tangs 151 has one end 93 attached to the gear guards 32A and 32B and the other end extending freely. Each of the tangs 151 has a hook portion 91 located approximately midway between its ends, dividing the tang 151 into an upper portion 153 and a lower portion 155. Grooves 154 are formed in the side of the gear guards 32A, 32B directly across from the tangs 151 to provide more area for the tangs 151 to be flexed inwardly. A ledge 157 is provided on the bottom edge of each groove 154. Pressing the tangs 151 inwardly disengages the brush assembly 20 from the housing 12, allowing removal of the brush from the cavity 48. Further details of the brush removal device are disclosed in co-owned U.S. Pat. No. 6,668,420 the disclosure of which is incorporated herein by reference.

Figure 3:
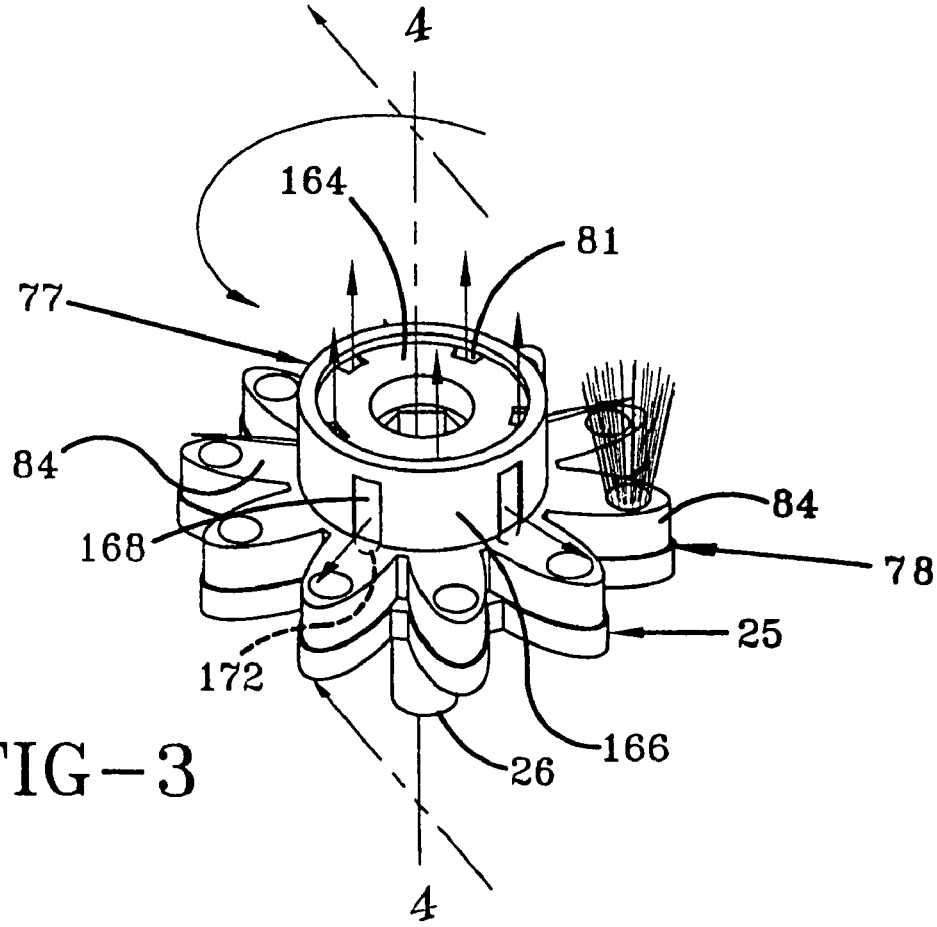
FIG. 3 is a bottom perspective view of the gear brush of one embodiment according to the present invention.
Figure 4:
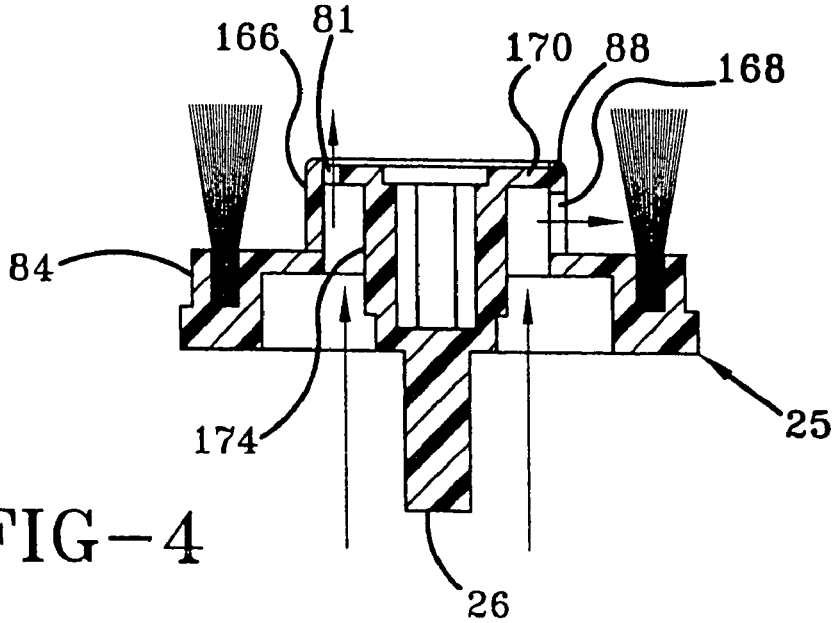
FIG. 4 is a sectional view taken along line 4-4 in FIG. 3.

Turning to the embodiment shown in FIGS. 3 and 4, as previously mentioned, the cleaning solution flows out of the openings 81, 168 in the brush cups 77. In particular, the center hub of the gear brushes 25 forms a hollow downwardly projecting cup 77. Each of the brush cups 77 generally comprises an upstanding circular shaped sidewall 166 and a circular shaped bottom wall 164. The bottom wall 164 has a multiplicity of openings 81 circumscribing around it. The sidewall 166 of the cup 77 is generally circular in shaped and includes a plurality of rectangularly shaped side openings or slots 168 spaced circumferentially there around. A circumferential rim 88 is provided about the bottom periphery of each cup 77 to prevent the openings 81 in the cups from getting caught in the carpet fibers and snagging them. The rim 88 is located radially outward from the openings 81 in the bottom of the cup 77 and adjacent to them. As depicted in FIG. 4, a plurality of ribs 170 integrally formed on the bottom wall 164 extends radially from the hub 174 to the sidewall 166.

Each side opening 168 extends downwardly from the top of the rim 88 of the cup 77 to approximately ¼ of an inch from the bottom of the rim 88. A c-shaped cut out portion 172, as viewed from the top, is formed at the top of the rim 88 and extends outwardly a distance into the lower profile 84 of the gear tooth 78. As best see in FIG. 3, each side opening 168 is located between bottom openings 81. Thus, as the brush cup 77 spins or rotates, cleaning solution flows simultaneously out of the side openings 168 and bottom openings 81 alternating between a side opening 168 and bottom opening 81 as one travels around the brush cup 77. Thus, cleaning solution is distributed equally in the axial and radial directions as illustrated by the arrows. In this embodiment, each side opening 168 is ⅛ wide by 5⁄16 inches long. However, the dimensions of the side opening 168 may be varied.

Figure 5:
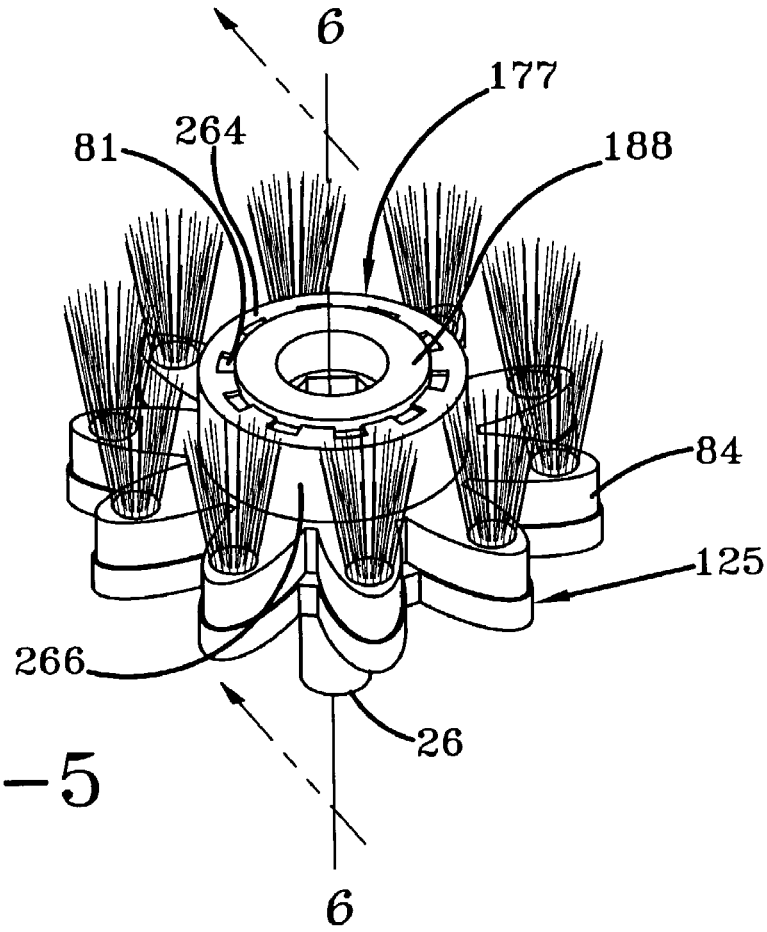
FIG. 5 is a bottom perspective view of the gear brush of another embodiment according to the present invention.
Figure 6:
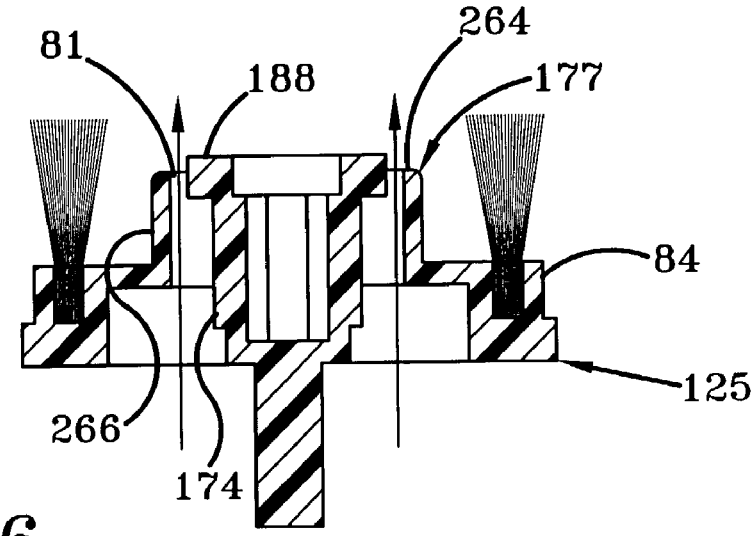
FIG. 6 is a sectional view taken along line 6-6 in FIG. 5

In another embodiment as shown in FIGS. 5 and 6, the gear brush 125 has a brush cup 177 that has an upstanding circular shaped sidewall 266 and a circular shaped bottom wall 264. In this and later embodiments, elements from the embodiment shown in FIGS. 3 and 4, which are identical in structure and have identical functions will be identified by the same reference numbers. The brush cup 177 only contains the openings 81 in the bottom wall 264. The openings 81 are twice as many as that shown in the embodiment of FIGS. 3 and 4. The circumferential rim 188 provided about the bottom periphery of each cup 177 is located radially inward from the openings 81 and adjacent to them to direct the cleaning solution away from the center of the brush cup 177. The rim 188 is also wider than that of the previous embodiment.

Figure 7:
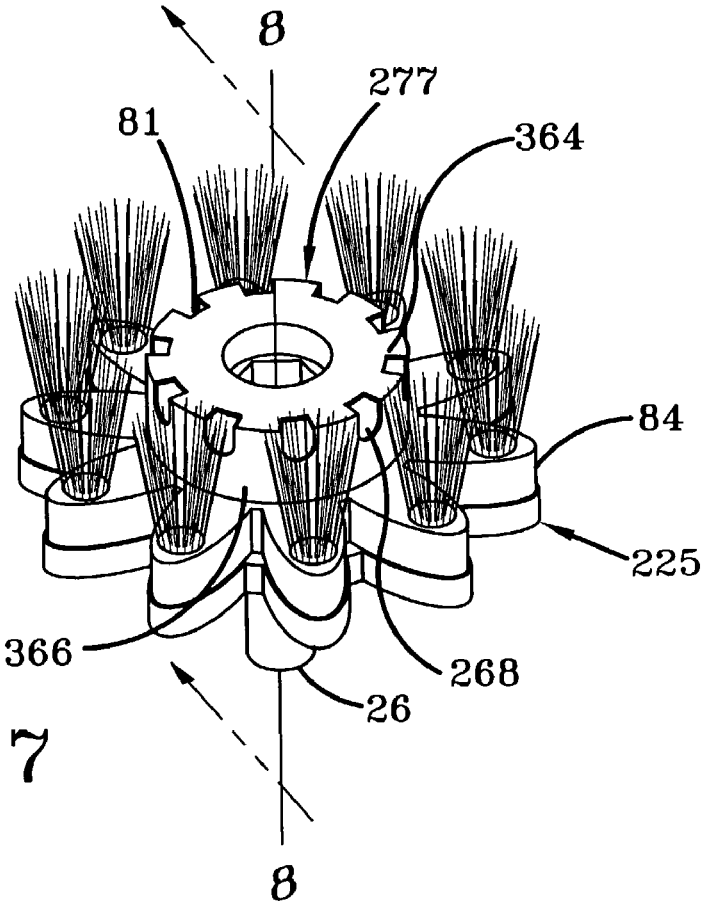
FIG. 7 is a bottom perspective view of the gear brush of another embodiment according to the present invention.
Figure 8:
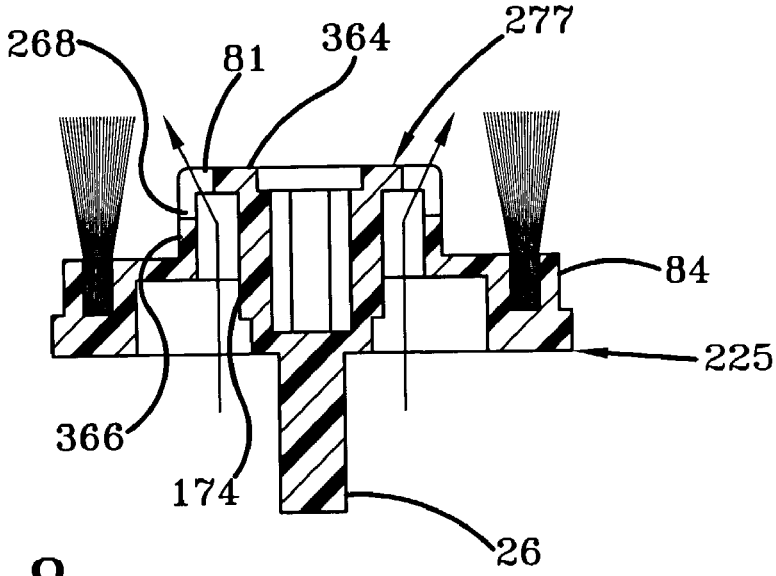
FIG. 8 is a sectional view taken along line 8-8 of FIG. 7.

In still another embodiment as shown in FIGS. 7 and 8, the gear brush 225 includes a brush cup 277 having an upstanding circular shaped sidewall 366 and a circular shaped bottom wall 364. The brush cup 277 has u-shaped side openings 268 near the bottom wall and formed together with the bottom openings 81. Though no rim is shown here, a rim could be positioned radially inward of the openings 81 as shown in FIGS. 5 and 6. The number of side openings 268 is the same as the number of bottom openings 81 and the number of bottom openings 81 is the same as that of FIGS. 5 and 6.

Figure 9:
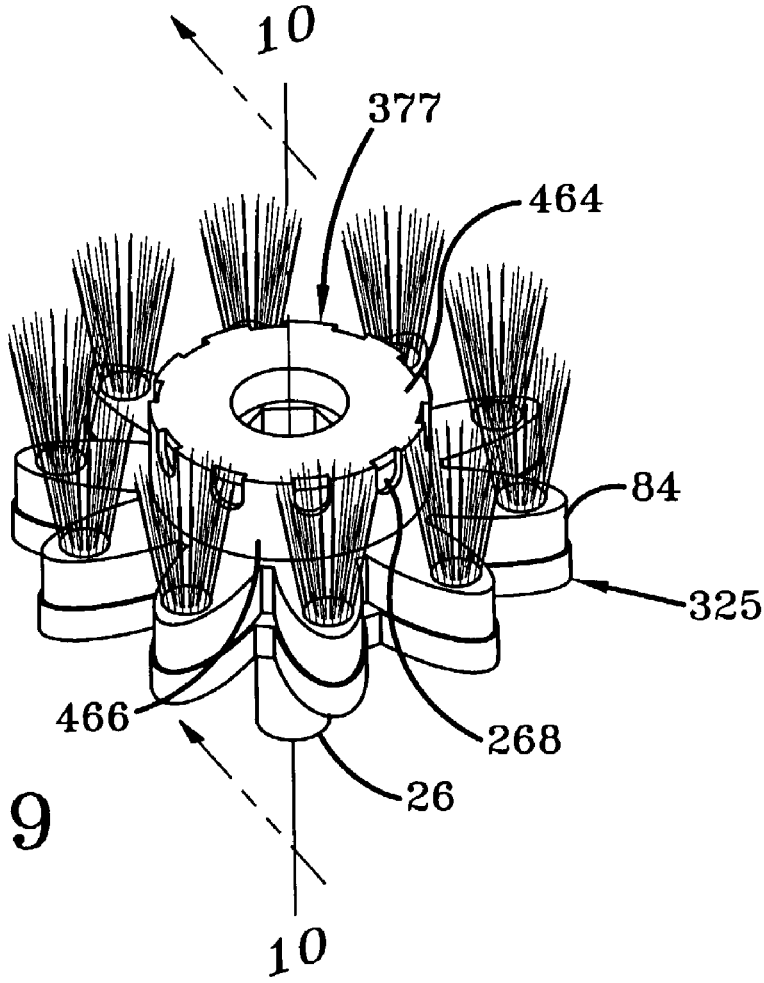
FIG. 9 is a bottom perspective view of the gear brush of still another embodiment according to the present invention.
Figure 10:
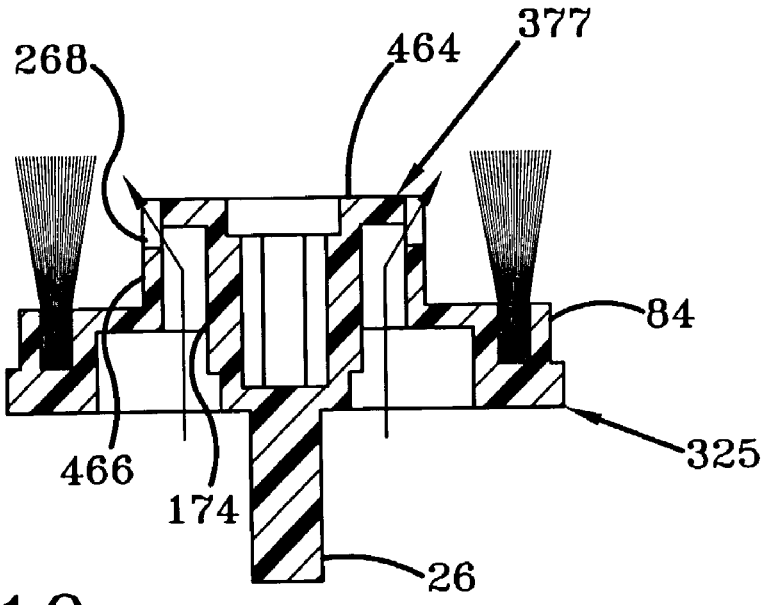
FIG. 10 is a sectional view taken along line 10-10 of FIG. 9.

In the embodiment shown in FIGS. 9 and 10, the gear brush 325 includes a brush cup 377 that has an upstanding circular shaped sidewall 466 and a circular shaped bottom wall 464. U-shaped side openings 268 are formed at the bottom portion of the sidewall 468 terminating out of the bottom wall 464. The side openings 268 are similar in design and number as that shown in FIGS. 7 and 8. There are no additional bottom openings 81. Cleaning effectiveness tests have been performed on carpets using an upright carpet extractor with this embodiment for comparison with that for the gear brushes containing only the bottom openings as shown in U.S. Pat. No. 6,009,594. Cleaning passes were done using an upright carpet extractor having model number F6040-900 and manufactured by the Hoover Company. These tests were performed at various flow rates and detergent concentrations of cleaning solution. The test revealed that the carpet cleaning effectiveness increased 7 to 11 percent from that of the carpet extractor with the gear brushes shown in U.S. Pat. No. 6,009,594.

Each of the gear brushes 125, 225, and 325 in the embodiments shown in FIGS. 6 through 10 also intermesh with a plurality of like gear brushes (from their respective embodiments) forming a brush assembly 20 that is mounted to the base module 10 of the upright carpet extractor, similar to the embodiment of FIGS. 3 and 4.

It has also been found that under a black light test in which the detergent contained a brightener that illuminated during the application of ultra violet light, the distribution of the cleaning solution on the cleaning surface was more uniform with radial distribution. For only axial distribution of the cleaning solution, areas of high concentrations of detergent were noticed.

The present invention has been described by way of example using the illustrated embodiment. Upon reviewing the detailed description and the appended drawings, various modifications and variations of the preferred embodiments will become apparent to one of ordinary skill in the art. All such obvious modifications and variations are intended to be included in the scope of the present invention and of the claims appended hereto.

What is claimed is:

1. A floor scrubbing machine having a main body and a cleaning fluid delivery system, comprising:

at least one rotatable brush having a brush body and bristles extending from said brush body, said brush being carried by said main body whereby the bristles of said brush engage a floor being scrubbed; and a fluid distributor for distributing fluid supplied to said fluid distributor to said brush, wherein said at least one rotatable brush includes a recess for receiving said fluid, said recess defined by a sidewall and a bottom wall, said sidewall and said bottom wall both having at least one opening for distributing said fluid radially outward, wherein said at least one opening in said sidewall may be continuous with said at least one opening in said bottom wall.

2. The floor-scrubbing machine of claim 1, wherein said recess includes a plurality of openings in said bottom wall and an equal number of openings in said sidewall.

3. The floor scrubbing machine of claim 1, wherein said recess includes a plurality of openings in said bottom wall and a plurality of openings in said sidewall, each said opening in said sidewall being located between two said openings in said bottom wall so that fluid flows out of said sidewall openings and said bottom wall openings, alternating between said sidewall and said bottom wall openings around the brush recess.

4. The floor-scrubbing machine of claim 1 wherein said at least one sidewall opening is continuous with said at least one bottom wall opening.

5. The floor-scrubbing machine of claim 1 including a rim extending downwardly from said bottom wall of said brush recess.

6. The floor-scrubbing machine of claim 5 wherein said rim is positioned radially outward from said at least one bottom wall opening.

7. The floor-scrubbing machine of claim 1 including a plurality of said rotatable brushes.

8. The floor-scrubbing machine of claim 7 wherein said rotatable brushes rotate about a vertical axis.

9. The floor-scrubbing machine of claim 1 including a brush support carried by said main body, said brush being carried by said brush support, said brush support being disposed beneath said fluid distributor and receiving fluid from said fluid distributor, a passage conveying said fluid from said brush support to said at least one brush.

10. The floor-scrubbing machine of claim 9 wherein said recess includes a plurality of openings in said bottom wall and an equal number of openings in said sidewall.

11. The floor scrubbing machine of claim 9, wherein said recess includes a plurality of openings in said bottom wall and a plurality of openings in said sidewall, each said opening in said sidewall being located between two said openings in said bottom wall so that fluid flows out of said sidewall openings and said bottom wall openings, alternating between said sidewall and said bottom wall openings around the brush recess.

12. A floor-scrubbing machine having a main body and a cleaning fluid delivery system, comprising:

at least one rotatable brush having a brush body and bristies extending from said brush body, said brush being carried by said main body whereby the bristles of said brush engage the floor being scrubbed; and a fluid distributor for distributing fluid supplied to said fluid distributor to said brush, wherein said at least one rotatable brush includes a recess for receiving said fluid, said recess defined by a sidewall and a bottom wall, said sidewall and said bottom wall both having at least one opening for distributing said fluid, wherein said at least one opening in said sidewall may be continuous with said at least one opening in said bottom wall, a rim extending downwardly from said bottom wall and positioned radially inward from said at least one opening.

13. A method of distributing cleaning solution on a cleaning surface using a cleaning machine having a brush assembly, said brush assembly having at least one rotatable brush having a brush body including a recess defined by a sidewall and a bottom wall, said sidewall and said bottom wall having openings, wherein the openings may be continuous, said method comprising the steps of:

a) flowing the cleaning solution into said recess; and b) rotating said brush such that the cleaning solution flows radially from said sidewall openings.

14. The method of claim 13 wherein the cleaning solution also flows axially from said bottom wall openings upon rotation of said brush.

15. The method of claim 14 wherein said sidewall and said bottom wall openings are arranged in said recess such that an equal amount of the cleaning solution flows axially and radially upon rotating said brush.

16. The method of claim 15 wherein said recess includes a plurality of openings in said bottom wall and a plurality of openings in said sidewall, each said opening in said sidewall being located between two said openings in said bottom wall so that cleaning solution flows out of said sidewall openings and said bottom wall openings, alternating between said sidewall and said bottom wall openings around the brush recess.

* * * * *